United States Patent [19]

Nakada et al.

[11] Patent Number: 4,463,473

[45] Date of Patent: Aug. 7, 1984

[54] VACUUM CLEANER

[75] Inventors: Seiichi Nakada; Hiromi Yoshikawa, both of Yokaichi; Hiroshi Ohno, Otu; Tsuneo Nishijima; Hiroshi Kawakami, both of Yokaichi, all of Japan

[73] Assignee: Matsushita Electric Industrial Co., Ltd., Osaka, Japan

[21] Appl. No.: 333,787

[22] PCT Filed: Apr. 17, 1981

[86] PCT No.: PCT/JP81/00090

§ 371 Date: Dec. 23, 1981

§ 102(e) Date: Dec. 23, 1981

[87] PCT Pub. No.: WO81/02971

PCT Pub. Date: Oct. 29, 1981

[30] Foreign Application Priority Data

Apr. 23, 1980 [JP] Japan ..... 55-56372[U]

[51] Int. Cl.[3] ..... A47L 9/19

[52] U.S. Cl. ..... 15/339; 15/413; 116/112

[58] Field of Search ..... 15/339, 413; 116/112, 116/67 R

[56] References Cited

U.S. PATENT DOCUMENTS

Re. 28,268 12/1974 Autrand ..... 15/339 X 3,381,652 5/1968 Schaefer et al. ..... 15/339 X

FOREIGN PATENT DOCUMENTS 53-100663 9/1978 Japan ..... 15/413

*Primary Examiner*—Chris K. Moore

*Attorney, Agent, or Firm*—Lowe, King, Price & Becker

[57] ABSTRACT

The present invention relates to a vacuum cleaner in which an alarm sound is generated by introducing air from the exterior in bypassing relation to a filter 8 when a suction load imposed on a fan motor 3 exceeds a predetermined value. The alarm sound can be emitted or stopped without adversely affecting the introduction of bypassing air toward the fan motor 3. With such an arrangement, the vacuum cleaner can be used conveniently, and the fan motor 3 is prevented from being burned out.

8 Claims, 9 Drawing Figures

VACUUM CLEANER

TECHNICAL FIELD

The present invention relates to a vacuum cleaner having an alarm device for audibly alerting users should an excessive suction load on a fan motor occur such as due to clogging of a vacuum cleaner filter.

TECHNOLOGICAL BACKGROUND

Prior art vacuum cleaners include a bypass air passage providing communication between a suction side of a fan motor and the atmosphere in bypassing relation to a filter, and a valve device mounted in the bypass air passage and arranged to open only when the filter is clogged or the pressure at the suction side of the fan motor is below a predetermined value when excessive amount of dust is collected.

With such vacuum cleaners, when the load imposed on the fan motor exceeds a certain value, the valve device operates to divert ambient air through the bypass air passage to the fan motor to prevent it from burning out.

Some vacuum cleaners also have a sound producing unit, such as a whistle, disposed in the bypass air passage and actuatable by an air flow to give off an alarm sound when the filter is clogged.

When the vacuum cleaner is used to clean tight places, such as corners of a room or narrow gaps behind pieces of furniture, the vacuum cleaner is equipped with a crevice tool having a constricted suction opening. Since the suction opening is narrower than that of an ordinary floor nozzle, the crevice tool offers a substantial amount of flow resistance to suction air as if the filter were clogged. Therefore, the sound producing unit would be activated to give off an alarm sound during normal cleaning operation. Such alarm sound could be prevented by forcibly closing the bypass air passage while the crevice tool is in use. However, the closed bypass air passage would block air supply to the fan motor which is being driven under full load. This results in overheating burning out of the fan motor.

DISCLOSURE OF THE INVENTION

According to the present invention, only an air passage for an alarm device can be opened or closed without having to close a bypass air passage, so that the alarm device may be energized or de-energized as desired while assuring safety of the fan motor.

An embodiment of the present invention will now be described with reference to the accompanying drawings:

The drawings show an embodiment of the present invention.

DETAILED DESCRIPTION OF THE PREFERRED EMBODIMENT

Figure 1:
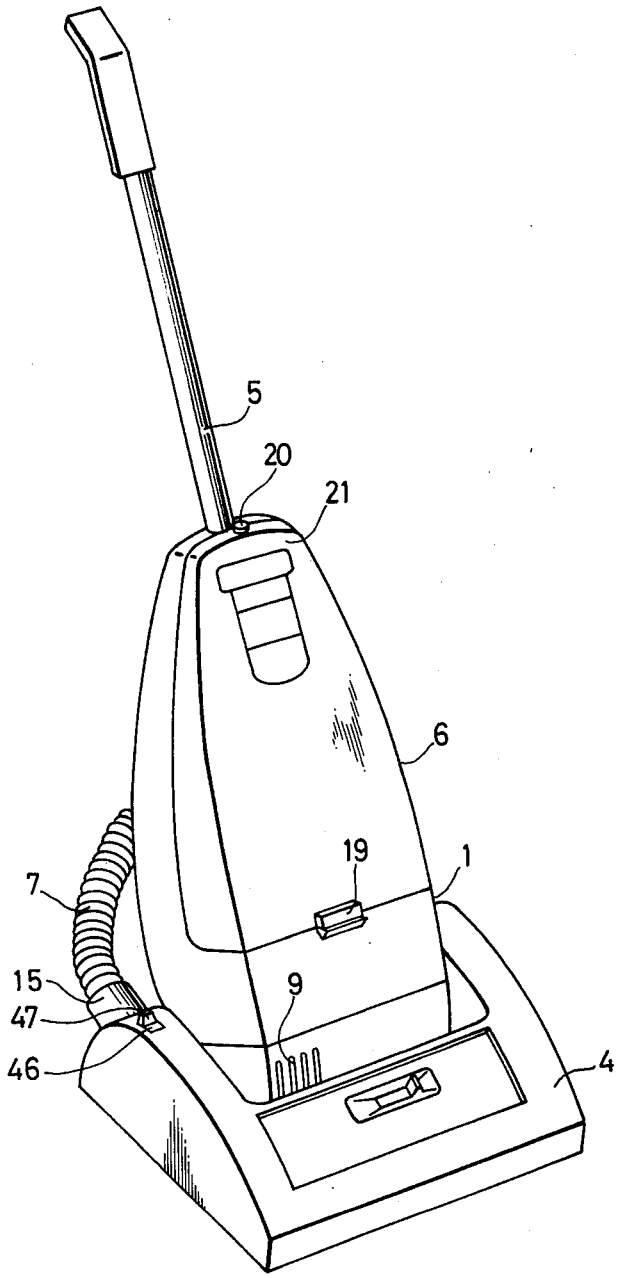
FIG. 1 is a perspective view of an upright vacuum cleaner.
Figure 2:
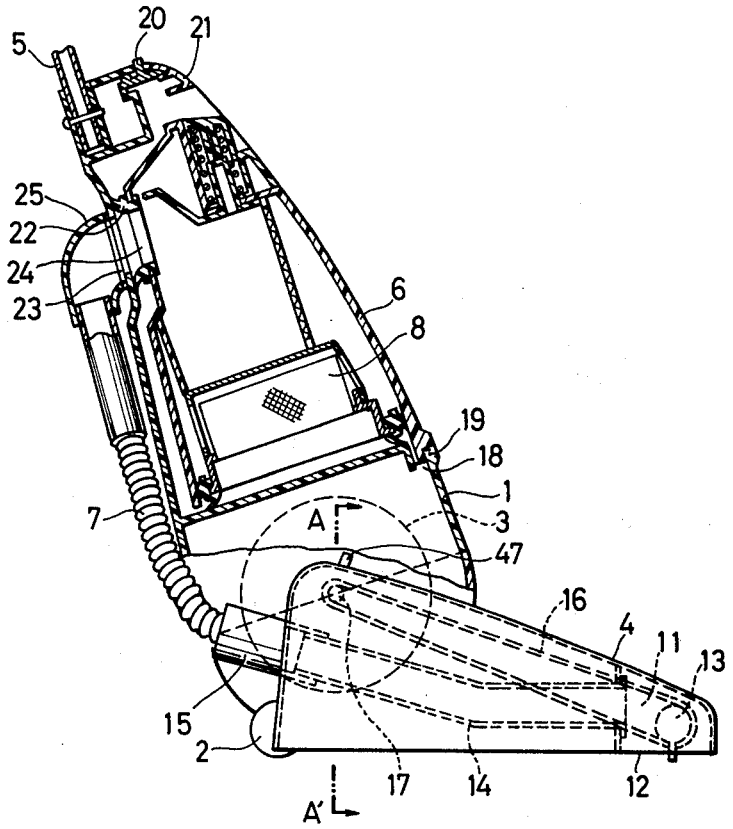
FIG. 2 is a cross-sectional view of the upright vaccum cleaner.

A main body includes a roller 2 at a bottom thereof and a suction fan motor 3 in a lower portion of the body. A floor nozzle 4 is pivotally mounted on main body 1 at the lower portion, and a handle 5 projects upwardly from the main body. A dust collector case 6 is disposed at a suction side of fan motor 3 and detachably mounted on a front portion of main body 1. Dust-laden air flows through floor nozzle 4 and a flexible hose 7 into dust collector case 6, where dust is filtered. Filtered air is discharged through fan motor 3 out of an air discharge opening 9 located in bottom of main body 1. The dust collected in dust collector case 6 can easily be disposed of by periodically removing the dust collector case from main body 1 removing filter 8, and opening the lower portion of the case.

Figure 3:
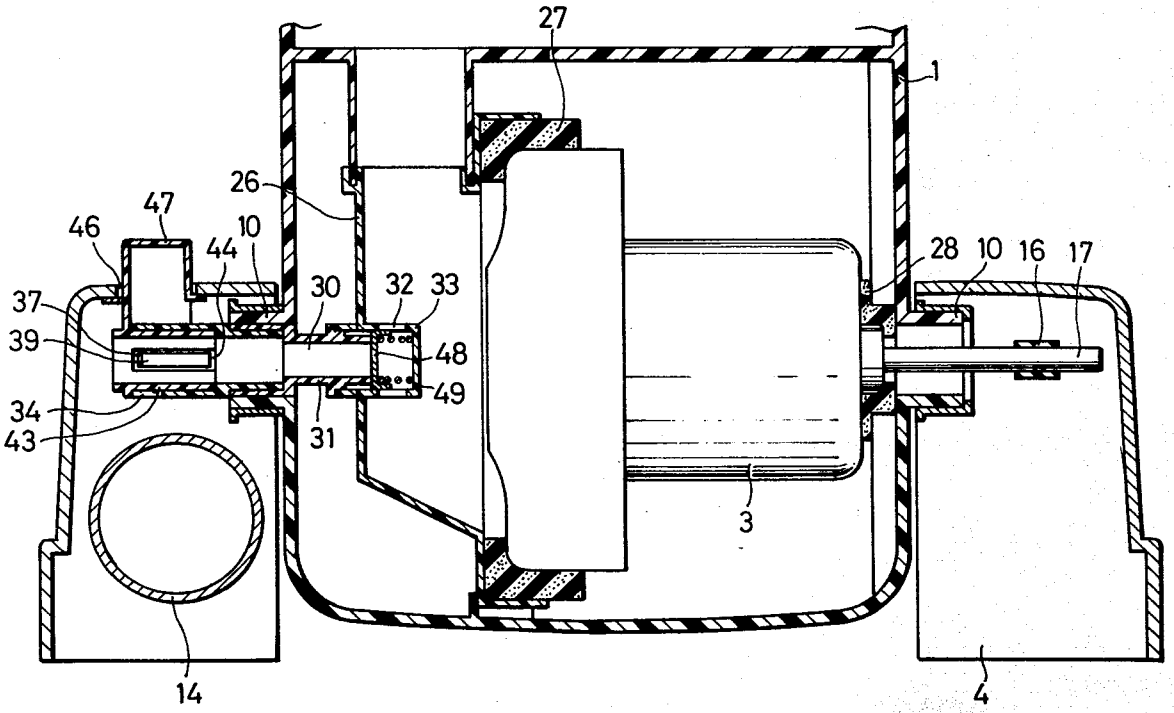
FIGS. 3 and 4 are cross-sectional views taken along the line A—A' of FIG. 2, FIG. 3 illustrating the cleaner in the normal position in which the filter is not clogged and FIG. 4 illustrating the cleaner in a position in which the filter is clogged.

Floor nozzle 4 is shaped to sandwich the lower portion of main body 1 at both sides thereof. Nozzle 4 is rotatably mounted on hollow shafts 10 projecting outwardly from both sides of main body 1 (FIG. 3). A suction chamber 11 has a suction port 12 opening at a bottom of floor nozzle 4 and housing therein a rotary brush 13. A suction tube 14 extends from the suction chamber 11 and has a distal end located in the rear of the floor nozzle 4 where a joint tube 15 mounted on one end of flexible hose 7 is detachably connected to the suction tube. A power transmission belt 16 extends under tension around and between a shaft 17 of fan motor 3 and rotary brush 13.

A lower end of dust collector case 6 has a projection removably engageable in a slot 18 in main body 1, and an upper grip 21 having a tail lock 20 removably engageable with the main body. A rear suction hole 24 formed in case 6 is held in communication with an air passage hole 23 in back of the main body 1 through an airtight gasket 22. An elbow pipe 25 provides communication between air passage hole 23 and the other end of flexible hose 7.

Air flows from suction port 12 in floor nozzle 4 into suction chamber 11, and then through suction tube 14, joint tube 15, flexible hose 7, elbow 25, and thence through air passage hole 23, suction hole 24 into dust collector case 6. Thereafter, air flows through filter 8, an air duct 26, and fan motor 3, for discharge through discharge opening 9. Fan motor 3 is fixedly mounted in position in main body 1 by resilient supports 27, 28 as of rubber.

Figure 9:
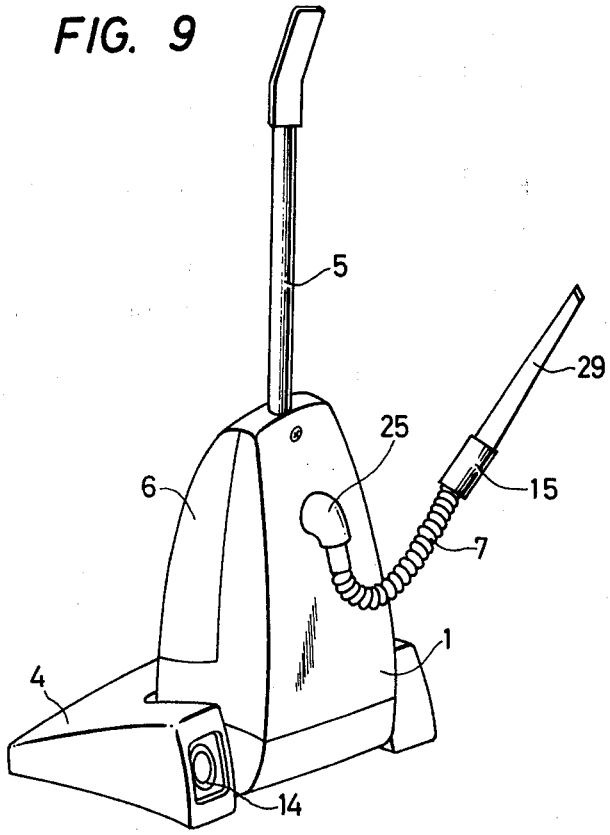
FIG. 9 is a perspective view of the upright vacuum cleaner when equipped with a crevice tool.

For cleaning tight places not reachable with floor nozzle 4 joint tube 15 on flexible hose 7 is disconnected from suction tube 14 and equipped with a crevice tool 29 as illustrated in FIG. 9. Flexible hose 7 should be used instead of another hose to allow easy cleaning operation within a certain area.

A bypass air passage 30 is disposed at suction side of the fan motor 3 for permitting communication between the atmosphere and the suction side of the fan motor without passing through filter 8. Bypass air passage 30 has one end vented directly to atmosphere and the other end opening into air duct 26 at suction side of the fan motor 3.

Figure 8:
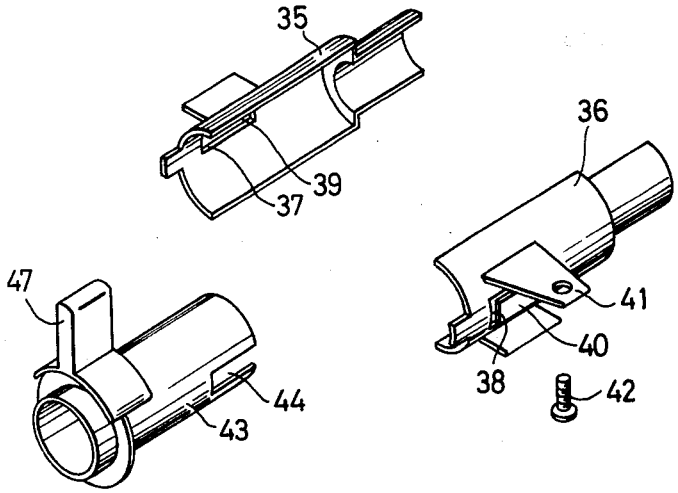
FIG. 8 is an exploded perspective view of the alarm device.

More specifically, the bypass air passage 30 comprises an air conduit 31 fixedly mounted in one of hollow shafts 10 on main body 1, conduit 31 has one end connected to a valve casing 33 having a circumferential wall integral with air duct 26 and opening into the air duct. The circumferential wall includes air outlet ports 32. Air conduit 31 is joined at the other end thereof to a sound producing cylinder 34 having open ends. The sound producing cylinder 34 is composed of a pair of semicylindrical members 35, 36 molded integrally of plastics and joined together (FIGS. 5–8). The semicylindrical members 35, 36 have oblong holes 37, 38 respectively, extending in the axial direction and integral vibratory members 39, 40 facing the oblong holes 37, 38, respectively, each including free ends. The sound producing cylinder 34 has one end press-fitted in and secured to the inner peripheral surface of air conduit 31, and is fixed to main body 1 by a screw 42 extending through mounting fin 41 (projecting from one of semicylindrical members 35, 36), as illustrated in FIG. 8. A sound control cylinder 43 having open opposite ends is rotatably inserted in sound producing cylinder 34. Cylinder 43 has in a circumferential wall therefore axial control slots 44, 45 which can be held in registration with oblong holes 37, 38, and further includes an external manipulator 47 projecting outwardly through an opening 46 defined in a top wall of floor nozzle 4. A pressure-responsive valve 48 is accommodated in valve casing 33 and is normally urged by a spring 49 to close one end of air conduit 31. When the pressure in air duct 26 drops below a predetermined value, valve 48 is displaced to open end of the air conduit 31 against bias of the spring 49.

Figure 4:
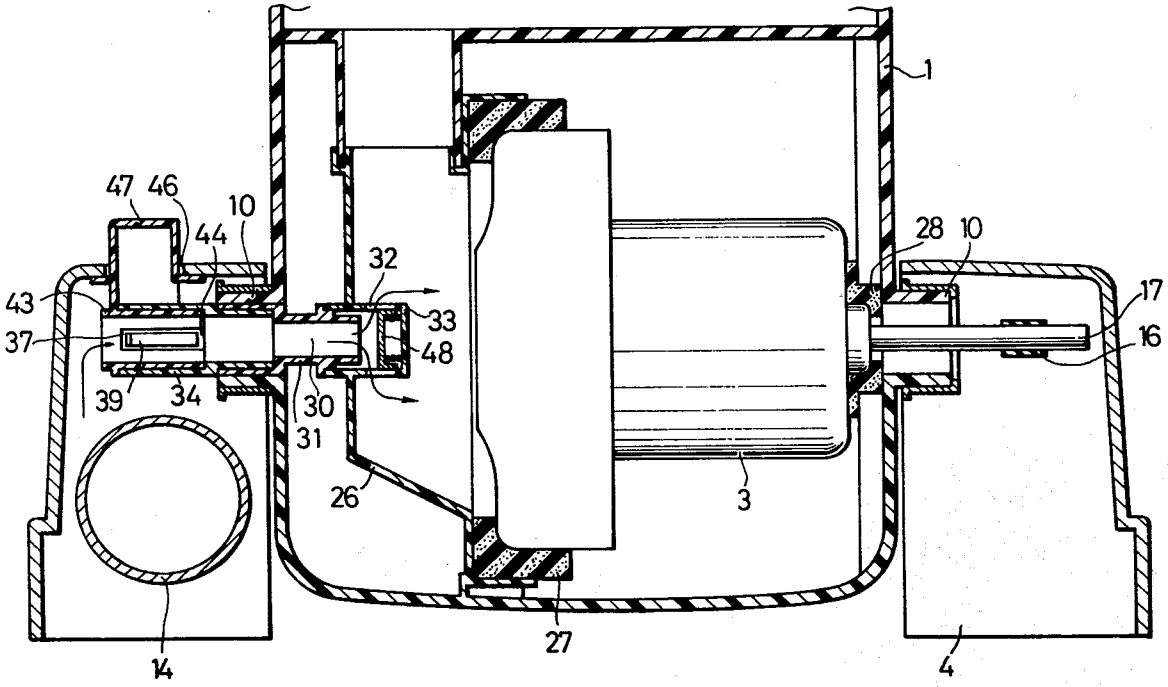
Figure 5:
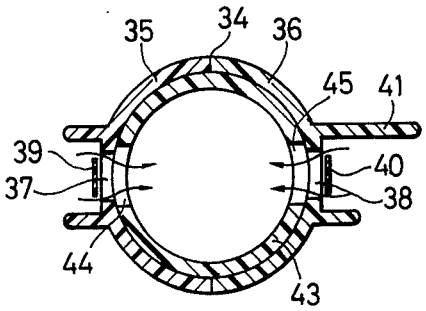
FIGS. 5 and 6 are transverse cross-sectional views of an alarm device, FIG. 5 showing the position in which an alarm is produced, FIG. 6 showing a position in which no alarm is generated.
Figure 6:
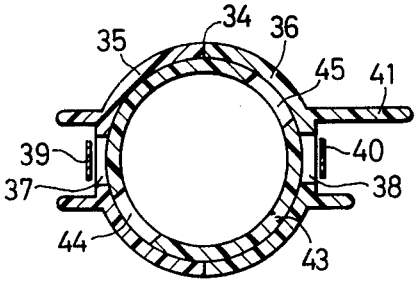
Figure 7:
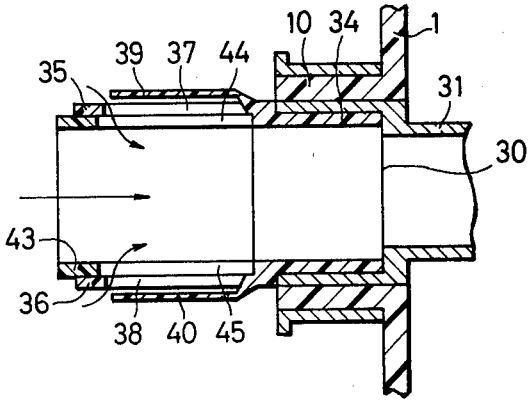
FIG. 7 is a longitudinal cross-sectional view of the alarm deivce.

When the vacuum cleaner is in operation for cleaning with floor nozzle 4, and as long as filter 8 remains unclogged, the pressure in air duct 26 is higher than the predetermined value, and hence pressure-responsive valve 48 is closed (see FIG. 3). As the amount of dust in collector case 6 increases, or if filter 8 clogs, the pressure in duct 26 at the suction side of fan motor 3 becomes lower than the predetermined value, causing valve 48 to open the end of air conduit 31 against the force of spring 49 as illustrated in FIG. 4.

The aforesaid movement of valve 48 opens bypass air passage 30, permitting air to flow towards fan motor 3 in bypassing relation to filter 8, thus preventing the fan motor from burning out due to operation under an excessive load.

The bypassing air flows partly through oblong holes 37, 38 in sound producing cylinder 34 and control slots 44, 45 in sound control cylinder 43, and partly through the open end of the sound control cylinder. The bypassing air as it enters slots 37, 38 and control slots 44, 45 causes vibratory members 39, 40 to emit a sound (see FIGS. 5 and 7), informing the user that the amount of dust collected has been increased to capacity, or filter 8 has been clogged, so that the user can throw away the collected dust or dust off the filter.

When the vacuum cleaner is used to clean tight places such as corners of a room with crevice tool 29 attached to joint tube 15 of flexible hose 7 as disconnected from suction tube 14 in floor nozzle 4, pressure-responsive valve 48 opens air conduit 31 since the crevice tool has greater air flow resistance therethrough even when the amount of dust collected is within a tolerable range, or the filter 8 is free of any clogging. At this time, however, external manipulator 47 is actuated to angularly move sound control cylinder 43 until control slots 44, 45 are brought fully out of registration with oblong holes 37, 38 in sound producing cylinder 34.

Consequently, oblong holes 37, 38 are closed by sound control cylinder 43 and no air flow is permitted therethrough. Vibratory members 39, 40 are then prevented from vibrating and giving off sound.

While unwanted generation of an alarm sound is being supressed, the bypassing air continues to flow through the open and of the sund control cylinder 43, so that there is no danger for the fan motor 3 to be operated under an excessive load.

The amount of air drawn through the filter 8 is reduced by the amount of bypassing air during opening of the air conduit 31. The speed of flow of air which is large enough to draw dust is however maintained due to the constricted opening in the crevice tool 29.

Since the mode of operation in which the crevice tool 29 is employed is a supplemental operation and is effected in a relatively short period of time, it has no substantial adverse effect on the efficiency of the vacuum cleaner.

Although in the embodiment the sound control cylinder 43 is angularly movable with respect to the sound producing cylinder 34, the sound control cylinder 43 may be slidable axially or may be arranged otherwise provided it can open and close the oblong holes 37, 38 in the sound producing cylinder 34 while maintaining a required amount of bypassing air.

Furthermore, two or more vibratory members 39, 40 may be provided which are of different thicknesses for varying tones so that the vibratory members will jointly produce a pleasing chord.

INDUSTRIAL APPLICATION

As described above, the present invention resides in that when the load imposed on the fan motor exceeds a predetermined value, a bypassing flow of air is introduced to prevent the fan motor from being burned out, and such an excessive load condition is indicated by sound to allow the user to take a necessary measure quickly against the undesirable condition. Generation of an alarm sound can be prevented by the user at will. Thus the vacuum cleaner of the invention is quite convenient to handle. Even if the fan motor is subject to an increased load while an adjustment is made to stop the emission of an alarm sound, the fan motor is nevertheless supplied with bypassing air. Therefore the fan motor is prevented from burning out in any case.

What is claimed is:

1. In a vacuum cleaner: a filter, a fan motor having a suction region disposed downstream of said filter, bypass air passage means vented directly to atmosphere and connected to communicate with said suction region of the fan motor in bypassing relation to said filter, and a pressure-responsive valve for opening or closing said bypass air passage means in response to change in pressure in said suction region past a predetermined value, said change in pressure being caused by dust collected within the vacuum cleaner, said bypass air passage means including an alarm sound producing unit actuated by an air flow through said bypass air passage means and a closure device mounted for manual actuation by the user to selectively prevent actuation of said sound unit by restricting airflow therethrough.

2. A vacuum cleaner according to claim 1, wherein said alarm sound producing unit comprises a plurality of vibratory members vibratable by said air flow to generate different sounds, respectively, which are combined into a synthesized sound.

3. A vacuum cleaner according to claim 1, wherein said alarm sound producing unit includes a sound producing cylinder having open ends, said closure device including a sound control cylinder having open ends, said cylinders being concentrically coupled together in said bypass air passage means, said sound producing cylinder having holes and vibratory members facing said holes, said sound control cylinder having control slots which can be held in registration with said holes, said sound control cylinder being movable relative to said sound producing cylinder to control said control slots so as to move into and out of communication with said holes.

4. A vacuum cleaner according to claim 1, further including a main body housing said fan motor, a dust collector device connected to receive dust laden air and discharge filtered air through an air duct into the fan motor suction region, and a floor nozzle angularly movably connected to hollow shaft means provided on the main body, said bypass air passage means being defined by a hollow portion in said hollow shaft.

5. In a vacuum cleaner: a filter, a fan motor having a suction region disposed downstream of said filter, bypass air passage means vented directly to atmosphere and connected to communicate with the suction region in bypassing relation to the filter, and a pressure-responsive valve for opening or closing said bypass air passage means in response to change in pressure in said suction region past a predetermined value, said change in pressure being caused by dust collected within the vacuum cleaner, said bypass air passage means including an alarm sound producing unit actuated by an air flow through said bypass air passage means and a closure device mounted for manual actuation to selectively prevent actuation of said sound unit while permitting air flow through the bypass air passage means to cool the fan motor.

6. In a vacuum cleaner: a filter, a fan motor having a suction region disposed downstream of said filter, bypass air passage means vented directly to atmosphere and connected to communicate with said suction region of the fan motor in bypassing relation to said filter and a pressure-responsive valve for opening or closing said bypass air passage means in response to a change in pressure in said suction region past a predetermined value, said change in pressure being caused by dust collected within the vacuum cleaner, said bypass air passage means including an alarm sound producing unit actuated by an air flow through said bypass air passage means and a closure device mounted for manual actuation by the user to selectively prevent actuation of said sound unit by restricting airflow therethrough, wherein said alarm sound producing unit includes a sound producing cylinder having open ends, said closure device including a sound control cylinder having open ends, said cylinders being concentrically coupled together in said bypass air passage means, said sound producing cylinder having holes therein and vibratory members facing said holes, said sound control cylinder having control slots which can be held in registration with said holes, said sound control cylinder being moveable relative to said sound producing cylinder to control said control slots so as to move into and out of communication with said holes.

7. In a vacuum cleaner: a filter, a fan motor having a suction region disposed downstream of said filter, bypass air passage means vented directly to atmosphere and connected to communicate with said suction region of the fan motor in bypassing relation to said filter, and a pressure-responsive valve for opening or closing said bypass air passage means in response to a change in pressure in said suction region past a predetermined value, said change in pressure being caused by dust collected within the vacuum cleaner, said bypass air passage means including an alarm sound producing unit actuated by an air flow through said bypass air passage means and a closure device mounted for manual actuation by the user to selectively prevent actuation of said sound unit by restricting airflow therethrough, further including a main body housing said fan motor, a dust collector device connected to receive dust laden air and discharge filtered air through an air duct into the fan motor suction region, and a floor nozzle angularly moveably connected to hollow shaft means provided on the main body, said bypass air passage means being defined by a hollow portion in said hollow shaft means.

8. The vacuum cleaner of claim 5 further including a crevice tool connected to draw dust laden air from the atmosphere and direct same through the filter so that filtered air enters the suction region, said filtered air producing a pressure within the suction region operable to open said pressure responsive valve and said bypass air passage means, said closure device being closed to prevent actuation of said sound unit.

* * * * *